US007073305B2

(12) United States Patent
Fong

(10) Patent No.: US 7,073,305 B2
(45) Date of Patent: Jul. 11, 2006

(54) COMPRESSION RING HORIZONTAL BRACING SYSTEM FOR BUILDING STRUCTURES

(76) Inventor: Charles K. Fong, 670 Weadley Rd., Radnor, PA (US) 19087

( * ) Notice: Subject to any disclaimer, the term of this patent is extended or adjusted under 35 U.S.C. 154(b) by 0 days.

(21) Appl. No.: 10/264,884

(22) Filed: Oct. 4, 2002

(65) Prior Publication Data

US 2003/0066263 A1 Apr. 10, 2003

Related U.S. Application Data

(60) Provisional application No. 60/327,182, filed on Oct. 4, 2001.

(51) Int. Cl.
*E04B 1/00* (2006.01)

(52) U.S. Cl. ..... 52/745.05; 52/1; 52/252; 52/236.2

(58) Field of Classification Search ..... 52/1, 52/167.1, 167.3, 223.3, 223.4, 231, 245, 52/248, 253, 741.3, 236.3, 234, 236.2, 246, 52/291, 223.6, 745.05, 222, 223.14, 252, 52/136.2, 272
See application file for complete search history.

(56) References Cited

U.S. PATENT DOCUMENTS

| | | | | |
|---|---|---|---|---|
| 1,960,328 | A * | 5/1934 | Breines | 52/222 |
| 2,889,018 | A * | 6/1959 | Swan | 52/246 |
| 4,270,323 | A * | 6/1981 | Crowley | 52/223.3 |
| 4,862,661 | A * | 9/1989 | Moore | 52/247 |

FOREIGN PATENT DOCUMENTS

| | | | |
|---|---|---|---|
| JP | 406317040 | * 11/1994 | 52/236.3 |

OTHER PUBLICATIONS

Jim Taylor, "Unique Design Creates Unique Challenges", Jun. 6, 2002, Seattle Daily Journal of Commerce.*
"Lateral Load Resisting System AAP Building", Jul. 30, 2001, website: http://www.arch.su.edu.au/kcdc/caut/html/AAP/lat.htm.*

* cited by examiner

*Primary Examiner*—Naoko Slack
(74) *Attorney, Agent, or Firm*—Woodcock Washburn LLP

(57) ABSTRACT

This invention provides a construction method having at least one compression ring and its bracing and reinforcing tension plane installed at a targeted floor level, where the compression ring and the tension plane form a structural bracing system to protect a new building or a existing building from an external horizontal impact.

20 Claims, 3 Drawing Sheets

COMPRESSION RING HORIZONTAL BRACING SYSTEM FOR BUILDING STRUCTURES

CROSS REFERENCE APPLICATION

This application claims priority from U.S. Provisional Patent Application No. 60/327,182 filed on Oct. 4, 2001.

BACKGROUND

Traditional tall buildings or tubular building structural systems utilize columns mainly to support typical vertical dead & live loads and horizontal wind & seismic loads. Nevertheless, this potential excessive-horizontal-impact problem becomes a reality after the Sep. 11, 2001 New York World Trade Center twin towers incident. Both twin towers, upon crashing by the hijacked airplanes from sideways, eventually collapsed. This tragedy reveals the inherited weakness of the traditional design for tall or tubular buildings especial for high rise buildings.

The invention, a compression ring horizontal bracing system, is designed to resolve the sudden excess horizontal impact problem a tall or tubular building structural systems have. This invention is applicable to new-construction or retrofit of existing buildings, and it provides improvement to deficiencies of tall buildings with tubular structural system. The material for the structural components could be steel, concrete, composite, combination or any material suitable to build these structural components. The bracing system could be provided at every level of the building floors or just at levels as required.

SUMMARY

With the compression ring horizontal bracing systems, building structures, especially tall buildings or tubular building structural systems, the building structure will be stiff enough to block the impact object from penetrating into the building and it also provides reliable bracings for the columns. Thus the building will be capable resisting external impact loads and preventing the building structure from progressive total collapse as what happened to the New York World Trade Center twin towers being crashed by the hijacked airplanes.

DETAIL DESCRIPTION OF THE INVENTION

A preferred method provided by the invention includes installing the compression rings in the required building floors, to rigidly tie all or a required number of exterior columns directly indirectly to the compression ring(s) at those floors in which the compression rings are installed. The number of exterior columns to be tied with the compression ring(s) is dependent upon the individual building design. Next, the floor members are arranged or modified in a way that the floor will act as a tension plane for the compression ring(s) Finally, the tension ring(s) are used as block-out(s) for the elevator/stairway with the support of the core column support framing, which ties the required number of core columns rigidly with the tension ring(s) as well.

Thus, for buildings with tubular structural system, the new bracing system at different required levels is arranged in a way that the floors will become load transferable diaphragms to the building tube. The building structure is capable of resisting external impact loads and preventing from progressive total collapse. It is because the invention is tying all or sufficient number of columns on the floor together to resisting any external horizontal impact load, instead of one or few at a time. In addition, the new floor system itself, with its compression ring(s) and tension plane (s), is built strong enough for resisting the external impact object from penetrating through the wall of the tube of the tubular system. As the building equipped with this invention is hit by the external impact object, the compression ring will be in compression to resist the impact, and the floor plane will be trying to maintain the shape of the compression with act in tension. If pretension force would be introduced in the tension plane, the compression ring will be provided with increased stiffness.

Finally, the compression ring(s) together with tension plane(s) provide reliable bracings to the columns thus avoiding the vulnerability from the progressive total collapse. The floor plane should be designed in a way that when overloaded by vertical loads, it would fail locally but would not cause the failure of the compression/tension rings; therefore the rings would continue to be functioned as bracings to the columns.

Figure 1:
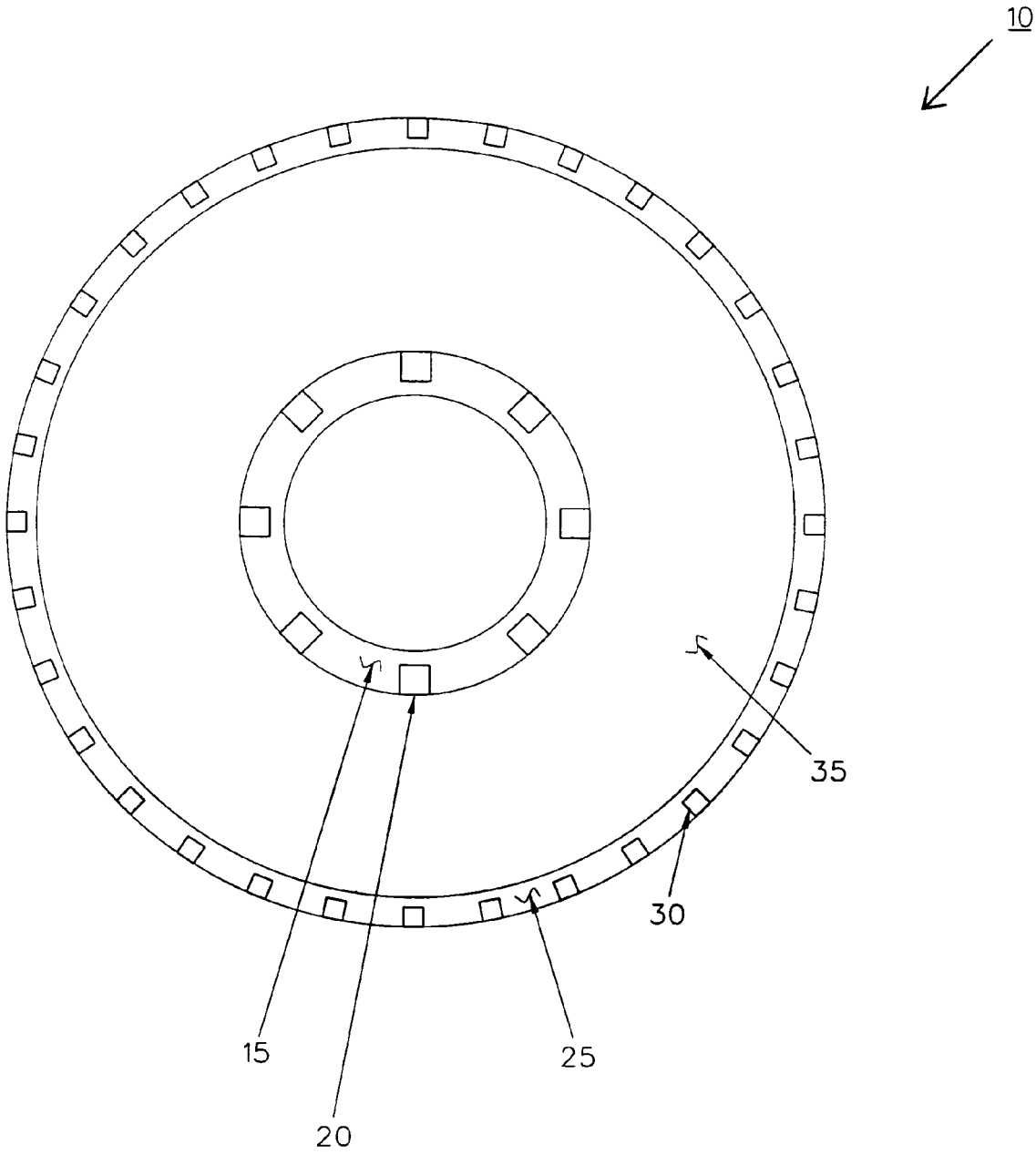
FIG. 1 illustrates an example of installing compression ring at a circular or an elliptical floor.

Refer to FIG. 1, the building floor 10 of this example is either in circular, elliptical or any compression ring shape. As shown in FIG. 1 the exterior columns 30 are rigidly tied to the compression ring 25. Tension ring 15 block-out is located in the middle of the floor tension plane 35. To further increase the lateral stiffness of the building system the core columns 20 are all rigidly tied to the tension ring 35. This is a very efficient layout, since all the columns are directly connected to the compression ring 25 and tension ring 15. The compression ring 25 and tension ring 15 could be either circular or elliptical or a combination of circular and elliptical.

Figure 2:
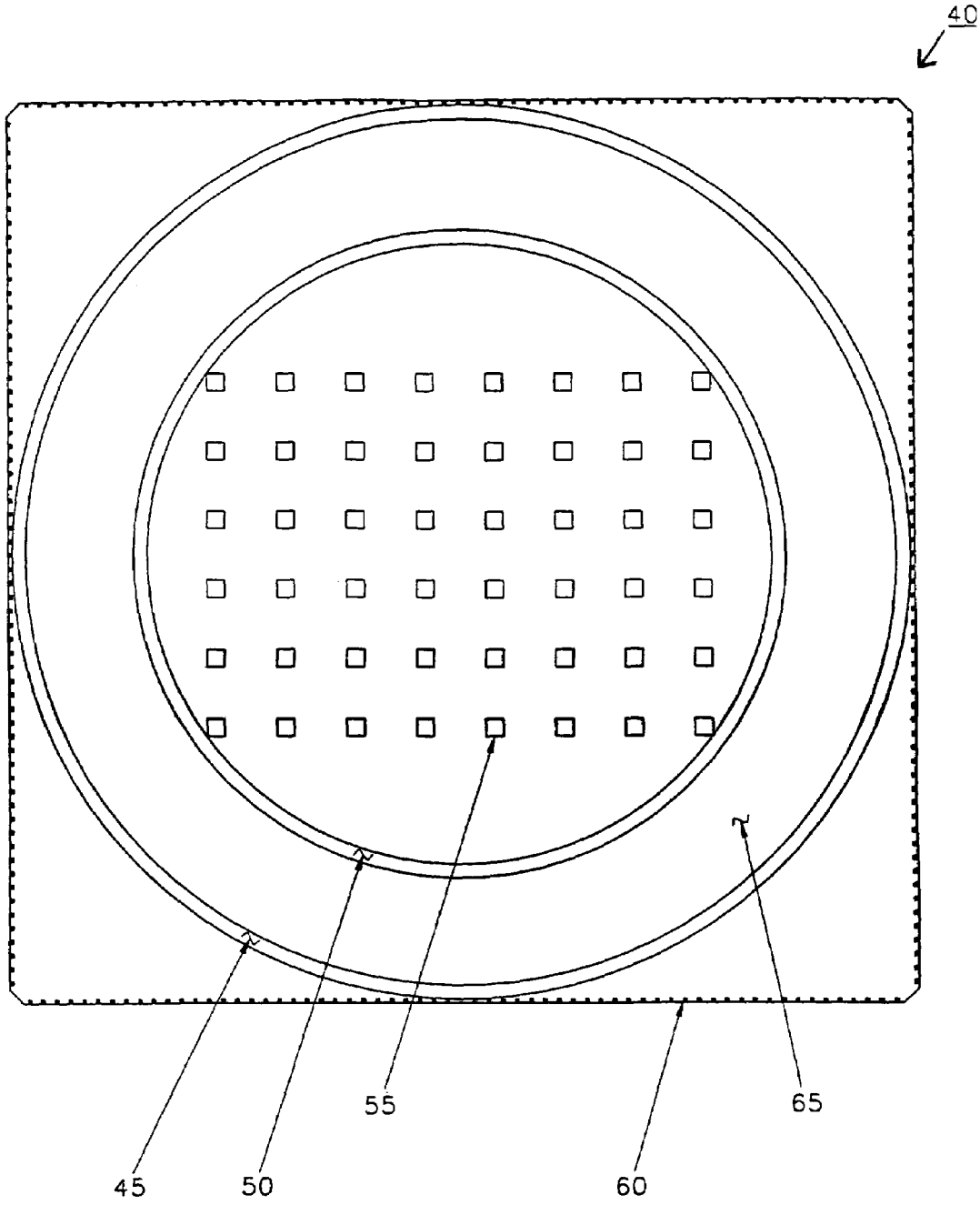
FIG. 2 illustrates an example of installing compression circular or elliptical ring at the square or near square rectangular floor.

Refer to FIG. 2, the building floor 40 shown in FIG. 2 is a square or near square reinforced by circular or elliptical compression ring 45. Sufficient exterior columns must be rigidly tied with the compression ring. Again the tension ring 50 blocks out the core columns 55 area. Since the core columns 55 are much stronger columns, it is an advantage to provide rigid ties between the core columns 55 and the tension ring 50. If the compression rings 45/tension rings 50 and the tension plane 65 have tied sufficient columns and have provided sufficient stiffness to bounce off the exterior object which creates the exterior impact load, and there are sufficient exterior columns having reliable bracings provided by the floor system to avoid the progressive collapse, then not all of those exterior columns 60 at corner areas are necessarily to be tied rigidly to the compression ring.

Figure 3:
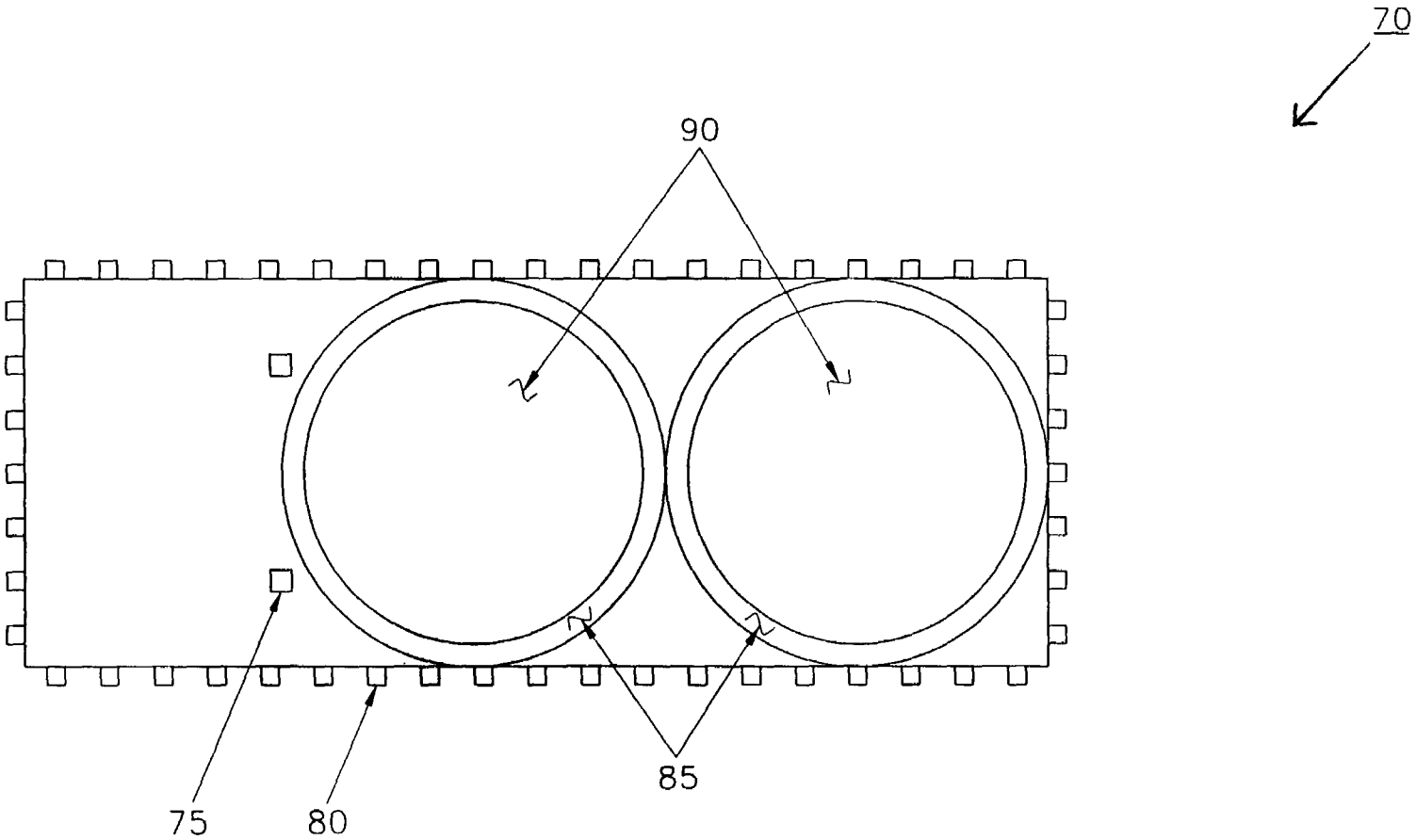
FIG. 3 illustrates an example of installing compression ring at the rectangular shape floor, where the rectangle has a significant ratio of longer side to shorter side.

As shown in FIG. 3, the rectangular shape floor 70 of this example has one side much bigger than the other. Provide 2 compression rings 85, one next to the other, and both rings 85 tie sufficient exterior columns 80 to the compression rings 85. The combination between the compression ring 85 and the tension plane 90 as a whole will provide sufficient stiffness to bounce off the exterior horizontal impact. Hide the weaker end, where columns have no rigid ties to compression ring, of the building at a location where it is not likely to receive any external impact load. Provide sufficient core columns in the weaker end and tie sufficient core columns 75 to the adjacent compression ring. Use the weaker end for elevator/stairway shafts.

Additional tension rings could be provided inside the compression ring as block-outs for safety escape stairways or elevators.

I claim:

1. A method for strengthening a building structure to resist horizontal impact and/or substituting a building structure's traditional bracing and flooring systems, the method comprising:

installing at least one continuous, curvilinear compression ring at a targeted story of the building structure so that the compression ring is coupled to more than two substantially vertical columns of the building structure whereby the compression ring can directly transfer structural loads between all of the more than two substantially vertical columns; and constructing within the compression ring at least one tension plane coupled to the compression ring and the more than two substantially vertical columns to brace and reinforce the compression ring and the more than two substantially vertical columns.

2. The method of claim 1, installing at least one tension ring within the tension plane to provide continuity with the tension plane.

3. The method of claim 2, wherein the tension ring has a substantially elliptical shape.

4. The method of claim 2, wherein the tension ring has a substantially circular shape.

5. The method of claim 2, further comprising installing the tension ring around an elevator core or an escape stair-case to provide continuity of the tension plane, where the tension ring enables the tension plane to transmit a substantially horizontal load between the more than two substantially vertical columns and the elevator core or the escape stair-case so that the substantially horizontal load is shared by the more than two substantially vertical columns and the elevator core or the escape stair-case.

6. The method of claim 5, further comprising coupling the tension ring and core columns of the building structure.

7. The method of claim 2, further comprising coupling the tension ring and the tension plane.

8. The method of claim 1, wherein the compression ring has a substantially elliptical shape.

9. The method of claim 1, wherein the compression ring has a substantially circular shape.

10. The method of claim 1, wherein constructing the tension plane comprises reinforcing a floor of the targeted story to form the tension plane.

11. The method of claim 1, wherein constructing the tension plane comprises reinforcing a ceiling of the targeted story to form the tension plane.

12. The method of claim 1, wherein constructing the tension plane comprises reinforcing both a floor and a ceiling of the targeted story to form the tension plane.

13. The method of claim 1, further comprising pre-tensioning the tension plane.

14. The method of claim 1, wherein the more than two substantially vertical columns are exterior columns of the building structure.

15. The method of claim 1, wherein the compression ring is uninterrupted along an entire length thereof.

16. The method of claim 1, wherein the compression ring is formed as a single piece.

17. The method of claim 1, wherein installing at least one continuous, curvilinear compression ring at a targeted story of the building structure so that the compression ring is coupled to more than two substantially vertical columns of the building structure comprises installing the compression ring so that the compression ring forms an curved section between adjacent ones of the vertical columns.

18. A method for strengthening an area of a building structure to withstand substantially horizontal structural loads, comprising:

interconnecting columns located proximate an outer perimeter of the area by way of a continuous, curvilinear ring member so that the substantially horizontal structural loads can be transferred between more than two of the columns by way of the ring member; and stiffening the ring member by connecting a substantially planar member to the ring member and the columns.

19. The method of claim 18, wherein the ring member is formed as a single piece.

20. The method of claim 18, wherein interconnecting columns located proximate an outer perimeter of the area by way of a continuous, curvilinear ring member comprises interconnecting the columns by way of the ring member so that the ring member forms an curved section between adjacent ones of the columns.

* * * * *